United States Patent [19]

Johnson

[11] Patent Number: 4,724,683

[45] Date of Patent: Feb. 16, 1988

[54] JOHNSON TUBE, A THERMODYNAMIC HEAT PUMP

[76] Inventor: Lonnie G. Johnson, 1463 E. Barkley Dr., Mobile, Ala. 36606

[21] Appl. No.: 864,772

[22] Filed: May 9, 1986

[51] Int. Cl.[4] ..... F28D 5/00

[52] U.S. Cl. ..... 62/467; 62/304; 62/86

[58] Field of Search ..... 62/467, 402, 86, 401

[56] References Cited

U.S. PATENT DOCUMENTS 4,476,693 10/1984 Johnson ..... 62/402

*Primary Examiner*—Henry A. Bennet

[57] ABSTRACT

The kinetic energy of a liquid flowing under pressure form a source is employed to power a heat pump for accumulating thermal energy in a controlled volume. The liquid is jetted at high speed into a low pressure region in a drift tube wherein a portion of the fluid flash vaporizes and decreases the temperature of the resulting liquid-vapor mixture. As the mixture flows through the drift tube, the liquid couples momentum to the vaporized portion and causes the vapor to flow to a high pressure region within the tube. As a result, the vapor compresses and is maintained in a saturated state by heat transfer across the liquid-vapor phase boundary of the mixture. During the compression process, heat is transferred to the mixture from the controlled volume so as to increase the vapor pressure of the liquid and thereby prevent condensation of the vapor portion until a desired temperature is attained. As the mixture leaves the tube and flow to the controlled volume, the vapor condenses and an additional, incremental temperature increase occurs.

13 Claims, 3 Drawing Figures

JOHNSON TUBE, A THERMODYNAMIC HEAT PUMP

BACKGROUND AND SUMMARY OF THE INVENTION

U.S. Pat. No. 4,476,693, entitled Thermal Energy Accumulation, issued Oct. 16, 1984, discloses a device for accumulating thermal energy in a controlled volume. It described a heat engine and heat-exchanger which operated in combination to extract thermal energy from fluid exiting the controlled volume to supply it to that entering the controlled volume. The device operated in a manner such that the fluid was eventually discharged containing less thermal energy than when initially supplied from its source. The disclosed invention derived operating power from the mechanical energy of the pressurized fluid flow and utilized the fluid as a working fluid in a heat engine. It employed a pump for compressing fluid vapor and included an impeller for extracting operating power from the pressurized fluid flow. The pump posed a number of difficulties the most significant of which was that of compressing a relatively large volume, low density vapor, and that of avoiding vapor compression into a superheated state which significantly increased pump energy requirements.

The present invention overcomes these difficulties by compressing the vapor in a drift tube which permits the vapor to be maintained in a saturated state during the compression process. In addition, the need for moving mechanical pump components, and a separate heat exchanger are eliminated. The drift tube includes a converging drift channel wherein a low pressure is maintained by a jet pump. The pump removes liquid and vapor from the drift channel so that vapor pressure of liquid flowing through the drift channel is the only significant pressure at any given location within the tube. Pressurized liquid supplied to a set of atomizing jets is injected into the drift channel at high speed as a mist of small liquid droplets. At the injection location, the vapor pressure is such that a portion of the liquid flash vaporizes. The temperature of the resulting liquid-vapor mixture decreases. Mechanical or electrical spray jets powered by a energy source other than pressurized fluid flow could also be used.

The jets are located at the entrance of the drift channel and are oriented so that the liquid droplets are aimed toward the center region of the drift channel's exit. The mass of the vapor is a small percentage of the total mass of the mixture and the momentum of the droplets dominates the behavior of the flow. As the momentum of the mixture carries it through the drift channel, the flow cross section of the channel decreases and the vaporized portion is compressed. The momentum of the flow decreases as work is performed in compressing the vapor. At the same time, heat from an external source is supplied to the mixture raising its temperature so that the vapor pressure of the liquid is increased. The process maintains the vapor in a saturated state and prevents condensation during compression. As the mixture leaves the flow channel, increasing pressure condenses the vapor and the fluid experiences an additional temperature increase.

Thermal energy is accumulated in the controlled volume by using the drift channel in a counter flow heat-exchanger configuration. Liquid leaving the drift channel flows through the control volume at an elevated temperature and returns. The returning liquid flows through a duct coupled to the drift channel, supplies heat to the lower temperature mixture in the drift channel and thereby functions as the external heat source. The counter flow arrangement results in the return water exiting the duct near the flash vaporization temperature of the original water entering the drift channel. The net effect is that the water exits containing less thermal energy than when originally supplied from the source. The difference in thermal energy is accumulated in the controlled volume.

DETAILED DESCRIPTION AND PREFERRED EMBODIMENT OF THE INVENTION

An application and supporting approximations for utilizing the invention to supply heated running water to a bathroom shower are presented. The disclosure is not intended to limit applications for the invention or to limit patent coverage.

Figure 1:
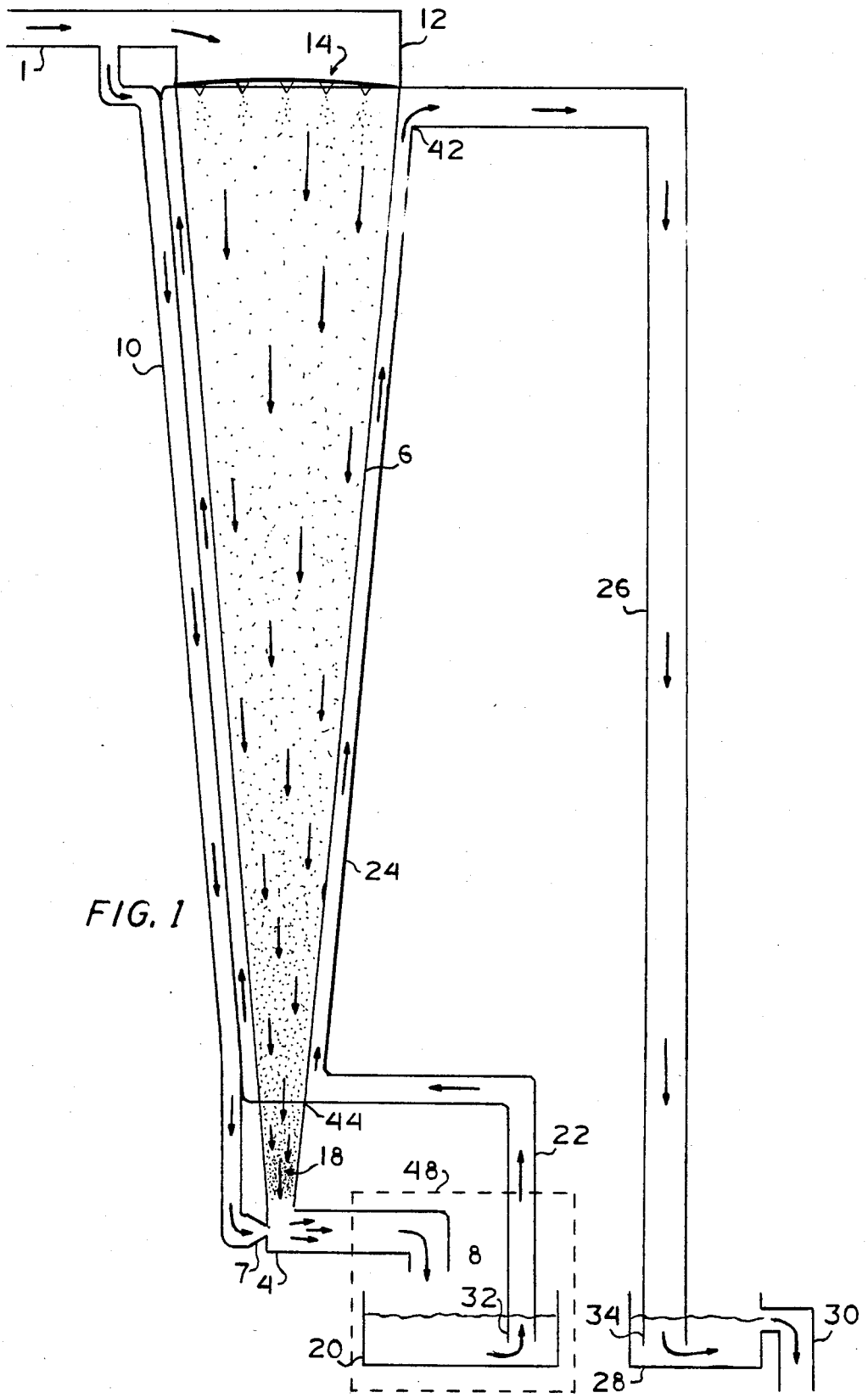
FIG. 1 shows a drift tube for accumulating thermal energy in a controlled volume. A drift channel is configured in combination with a flow annulus as a counter flow heat exchanger wherein heat is transferred to liquid-vapor mixture inside the drift channel flowing toward the controlled volume from waste liquid in the annulus flowing away from the controlled volume.

FIG. 1 shows a thermal energy accumulation means for accumulating thermal energy in a controlled volume. The drawing depicts a drift tube means which includes duct 1, atomizing jet injector means 14, converging drift channel means 6, and flow actuated jet pump means 4. Fluid enters the device through duct 1 from a pressurized source such as a water main. A small portion of the water flows to jet pump means 4 which includes feed water heater duct means 10 and nozzle means 7. Operating power for pump 4 is derived from prressurized fluid flowing thereto from duct 1. Pump 4 operates to remove fluid from drift channel 6 and thereby operates to maintain a low pressure therein. Fluid flowing through nozzle 7 is accelerated to a high velocity to produce a jet pump effect.

The remaining water from duct 1 flows to manifold means 12. Manifold 12 supplies pressurized water to atomizing jets 14. The jets inject water into drift channel 6 at high speed as a very fine mist. The jets are mounted in an orientation such that the water droplets forming the mist are aimed down the flow channel toward high vapor pressure region 18. Water exiting drift channel 6 flows through jet pump 4, exits shower head means 8 and enters collection tank means 20. Shower head 8 and collection tank 20 comprise a controlled volume wherein thermal energy is accumulated. Water is removed from tank 20 by a siphon means comprised of a heat transfer duct means which includes inlet means 22, inlet port means 32 and annulus flow section means 24, and an exit duct means which includes return duct means 26 and outlet port means 34. Duct 26 empties into reservoir tank means 28 which functions to prevent air from entering the siphon. Inlet port 32 and outlet port 34 are below the water level of tanks 20 and 28 respectively. As water enters tank 20 from shower head 8 and the water level rises, the siphon operates to insure the water level in both tanks remains equal and conducts water from tank 20 to reservoir 28. Water is drained from reservoir 28 through over-flow duct 30.

The drift channel functions as an evaporator a compressor and a heat exchanger. A portion of the water mist injected into drift channel 6 by jets 14 flash vaporizes due to the low pressure maintained in the drift channel. The momemtum of the injected mist maintains the low pressure region near jets 14 by carrying the liquid-vapor mixture to high pressure region 18 produced at the opposite end of the drift channel. In the flash vaporization process, the temperature of the mixture is decreased below the original source water temperature. As the mixture moves through the drift channel, the vaporized portion is compressed due to the decreasing flow cross section and produces high vapor pressure region 18. The vapor is maintained in a saturated state due to heat transfer across the vapor-liquid boundary. Condensation of the vapor is prevented by raising the vapor pressure of the liquid portion of the mixture by transferring heat to it from liquid flowing in the opposite direction through the heat transfer duct. The heat transfer duct functions as an external heat source and is configured having annulus flow section 24 positioned around drift channel 6. Heat is also transferred from annulus section 24 to water flowing to jet pump 4 through duct 10 so that it enters pump 4 near the temperature of fluid being removed thereby from high pressure region 18.

The resulting effect of heat transfer between the mixture in the flow channel and the liquid in the annulus is that water exiting the annulus at location 42 leaves near the temperature of flash vaporization process occurring in the drift channel. The wafer exits at a temperature which is lower than its temperature was when originally supplied from the source. The thermal energy difference is accumulated in controlled volume 48 represented by shower head 8 and tank 20. At the entrance of annulus 24 at location 44, the temperature of the mixture inside the channel is near that of the water exiting the controlled volume through duct 22. Beyond annulus 24, down the drift channel, compression of the vapor continues. The vapor condenses and the temperature of the water entering jet pump 4 is increased above that of the water exiting the controlled volume through duct 22. The result is that under ideal conditions, the temperature of the water flowing to the controlled volume is always greater than that leaving the controlled volume. Thermal energy is accumulated in the controlled volume and the temperature is always increasing.

Figure 2:
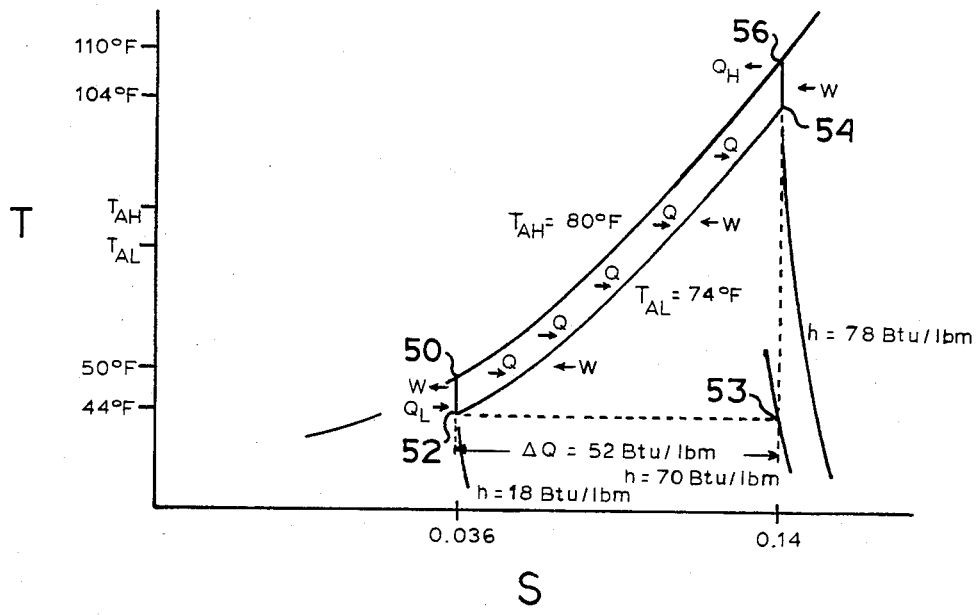
FIG. 2 is a temperature-entropy diagram depicting the state changes experienced by the liquid-vapor mixture as it flows through the drift channel.
Figure 2:
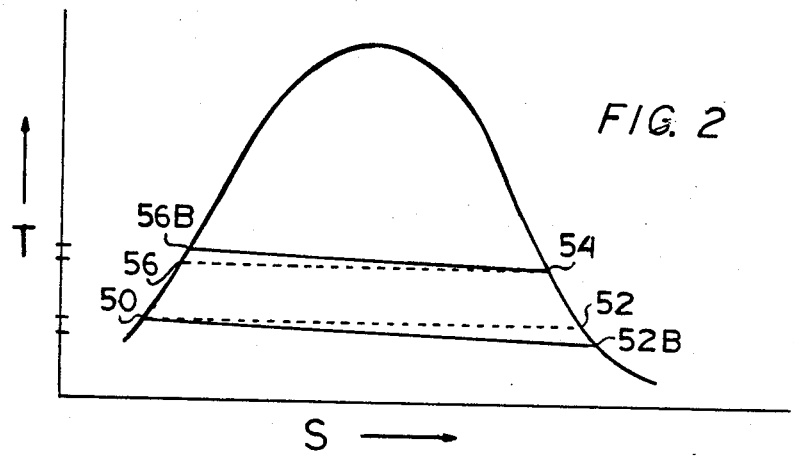

The temperature entropy (TS) diagram shown in FIG. 2 depicts the state changes experienced by the fluid as it flows through drift channel 6. Since only a small portion of the liquid vaporizes, the mixture has low quality and remains near the saturated liquid line. Ideally, the amount of vaporized fluid remains constant as it flows through the drift channel. The water mist is initially injected into the channel at state 50. Flash vaporization of a portion of the liquid occurs and the mixture goes to state 52 experiencing a temperature decrease. The mixture transitions from state 52 to state 54 as it is compressed while flowing through the channel. The vapor portion is maintained in a saturated state by heat transfer across the liquid-vapor phase boundary of the mist. This process is not isentropic and is, therefore, different from that normally experienced during compression in heat engines. Since only a small portion of the mixture is in a vapor state, heat transfer to the mixture is necessary to raise the temperature of the liquid portion to maintain equilibrium between the two phases. Point 54 on the TS diagram corresponds to location 44 of the drift channel. Heat transfer to the mixture stops and further compression causes the vapor to transition to state 56. The temperature of the mixture increases as the vapor condenses. Work is performed in the drift channel in compressing the vapor in going from state 56 to state 56.

As an example, assume water enters duct 1 from a water main at 50° F. and a pressure of 80 psig (above ambient), and that the invention has been operating for a period of time sufficient to accumulate an amount of energy such that water is entering the controlled volume at 110° F. Further assume a maximum of one pound mass of water is maintained in the controlled volume at all times, and that the flow rate into the drift channel from the atomizing jets and the cross section of the drift channel's entrance are such that 0.5% of the water flash vaporizes. An approximation will be made of $W_c$, $Q_{ev}$ and $T_r$, the rate of compressive work performed, the amount of heat extracted from water flowing through the annulus attributable to the heat pump process occurring in the drift channel, and the rate at which the temperature of water in the controlled volume is increasing respectively. From the thermodynamic properties of water, the heat of vaporization at 50° F. is 1083 Btu/lbm. The 0.5% vaporization in a heat consumption of:

$$Q_{ev} = M_{ev}h_{ev}$$
$$= .005M_t\text{lbm} \times 1083 \text{ Btu/lbm}$$
$$= 5.4M_t\text{Btu},$$

where $Q_{ev}$ is the net heat extracted in the vaporization process, $M_{ev}$ is the mass of the vaporized fluid, $h_{ev}$ is the heat of vaporization, and $M_t$ is the total mass flow into the channel. The temperature change of the mixture is given by:

$$Q_{ev} = M_t C_p \Delta T$$
$$\Delta T = Q_{ev}/M_t C_p.$$

Using a specific heat, $C_p$, of 1 Btu/lbm°F. for water, and substituting for $Q_{ev}$, the equations yield a temperature decrease, $\Delta T$, of 5.4° F. The decrease results in a temperature at location 52 on the TS diagram of 44.6° F. The compressive work performed in going from state 52 to state 56 is approximated as follows.

By transferring heat to the mixture during compression, the mixture goes from state 52 directly to 54. State 53 is avoided. The work required in the process is reduced by approximately one half that needed for a process passing through state 53. The average temperature at which heat is transferred to the mixture is increased from 44.6° F. to about 74° F., about half-way to 110° F. for the same entropy change. The heat input can be approximated as the average heat input temperature times the change in entropy, 74° F.×0.104 Btu/lbm°F.=55 Btu/lbm. Adding this value to the original state of the fluid at state 1 gives 73 Btu/lbm, 18+55. The difference between this value and the energy content of the fluid at state 54, 78 Btu/lbm, is 5 Btu/lbm. Including the 0.6 Btu/lbm needed to go from state 54 to 56 gives a total energy input of 5.6 Btu/lbm. The ratio of heat supplied to state 3 to work input is 9.8, 55 Btu/lbm/5.6 Btu/lbm. The Carnot coefficient of performance, $\beta$, for an engine operating between 110° F. and 50° F. is 9.5, $T_H/(T_H-T_L)$ or 570° R/(570° R−510° R)5. Considering the rough approximations in the foregoing evaluation, it should be apparent that the engine approaches Carnot efficiency.

The Pump energy, $E_p$, available from the source water at 40 psig can be approximated at zero velocity as:

$$E_p = M_t \int v dP$$

where v is the specific volume of the water, and dP denotes the pressure difference between the source pressure, $P_S$, and the low pressure at the entrance to drift channel, $P_L$. Using the water's vaporization pressure at 44.6° F. as a value for $P_L$, vdP can be approximated as:

$$\int v dP = v(P_S - P_L)$$

$$= .01608\ \text{ft}^3/\text{lbm} \times (80.0 - 0.147)\text{lbf/in}^2 \times 144\ \text{in}^2/\text{ft}^2/778\ \text{ft-lbf/Btu}$$

$$= 0.238\ \text{Btu/lbm.}$$

If water is supplied to manifold 12 at a rate of 4 gallons per minute, the total mass flow rate into the drift channel, $M_t$, is 0.56 lbm/sec. The available pump energy is:

$$E_p = M_t \int v dP$$

$$= 0.56\ \text{lbm/sec} \times 0.238\ \text{Btu/lbm}$$

$$= 0.13328\ \text{Btu/sec.}$$

The total energy, $E_t$, pumped to state 56 through vapor compression is:

$$E_t = \beta \times E_p$$

$$= 9.5 \times 0.13328\ \text{Btu/sec}$$

$$= 1.27\ \text{Btu/sec}$$

$$= 1.33\ \text{kilowatts.}$$

For one pound mass of water maximum maintained in the controlled volume, $M_{cv}$, the rate of temperature increase in the controlled volume, $T_r$, is given by:

$$T_r = E_t/M_{cv}/C_p$$

$$= 1.27\ \text{Btu/sec}/1\ \text{lbm}/1\ \text{Btu/lbm°F.}$$

$$= 1.27°\ \text{F./sec}$$

Figure 3:
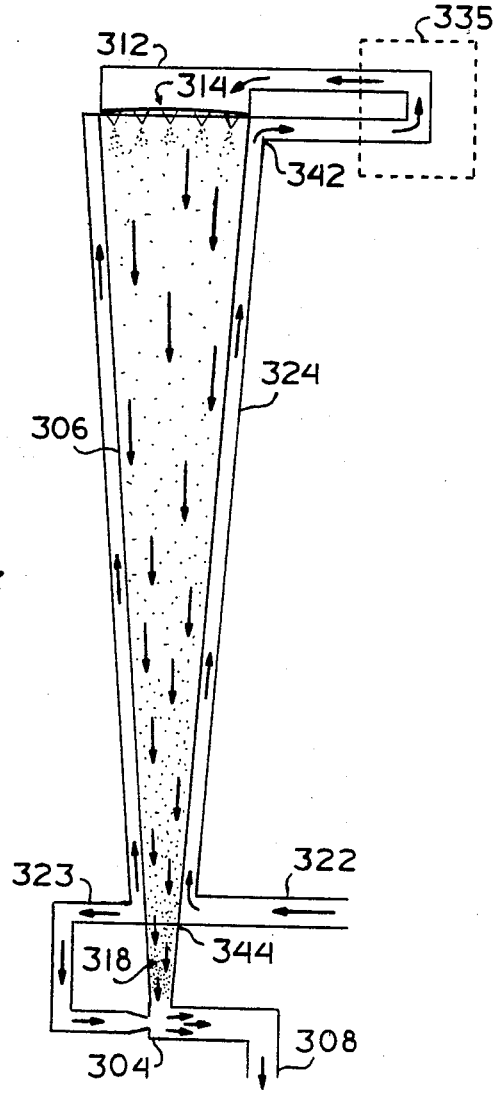
FIG. 3 shows a drift tube for depleting thermal energy from a controlled volume. A drift channel is configured in combination with a flow annulus as a counter flow heat exchanger wherein heat is transferred to liquid-vapor mixture inside the drift channel flowing away from the controlled volume from liquid in the annulus flowing toward the controlled volume.

There are many other applications of the invention. FIG. 3 shows a modified version for depleting thermal energy from a controlled volume. Pressurized fluid enters from a source through duct 322 and flows through heat transfer duct 324 where it is cooled by heat transfer to a lower temperature liquid-vapor mixture in converging drift channel 306. The fluid exits through duct 342 and flows through controlled volume 335 at low temperature. The pressurized fluid exits the controlled volume into manifold 312 and is injected into drift channel 306 at high speed by atomizing jets 314. Drift channel 306 is maintained at a low pressure by jet pump 304 which operates on a small pressurized flow through duct 323. A portion of the fluid entering drift channel 306 flash vaporizes and the temperature of the resulting liquid-vapor mixture is decreased below that of liquid entering manifold 312 from the controlled volume. The lower temperature causes the temperature of water flowing from anulus 324 to the controlled volume at any given time to be lower than water exiting the controlled volume. The effect is to contunuously deplete thermal energy from the controlled volume by continuously supplying colder and colder water to it. As the momentum of the mixture inside the drift channel carries it to the high pressure region 318 near the channel's exit, the vaporized portion is compressed while being maintained in a saturated state. Heat is transfered from annulus 324 to raise the temperature of the mixture during the compression process in the drift channel to prevent vapor condensation. At location 344, its temperature is near that of fluid entering duct 322 from the pressurized source. As the mixture continues toward pump 304, its pressure is increased further and the vaporized portion condenses and the fluid's temperature is further increased. The fluid flows through pump 304 and exits through drain 308 at a temperature above that it had when originally supplied from its source, the difference in internal energy being the energy depleted from the controlled volume. The continuous fluid flow results in a continuous depletion of energy from controlled volume 335 and a continuously decreasing temperature under ideal conditions.

The invention offers a practical heat pump which approaches Carnot efficiency and which eliminates the need for mechanical members for pumping working fluid in the vapor phase. In addition, when the engine is used in an open cycle in conjunction with a pressurized fluid source, temperature changes can be achieved with out the use of any moving mechanical parts.

What is claimed is:

1. A drift tube means for operating as a heat pump in combination with a source of fluid flow to provide thermal energy at an elevated temperature, said drift tube means utilizing said fluid as a working fluid therein by causing a portion of said fluid to undergo thermodynamic phase changes to effect heat transfer, said drift tube means including a jet injector means, fluid from said source flowing through said jet injector means and thereby being increased in velocity and thereby in kinetic energy, said drift tube means being configured to facilitate maintenance of a low pressure region and a high pressure region internal to said drift tube means, said jet injector means being configured to inject said fluid into said low pressure region inside said drift tube means at high speed wherein a portion of said fluid flash vaporizes and decreases the temperature of the resulting liquid-vapor mixture, said liquid-vapor mixture moving at high speed and having sufficient momentum to cause said mixture to flow to said high pressure region within said drift tube means whereby said vaporized portion is compressed, said vapor being maintained in a saturated state due to heat transfer across the liquid-vapor phase boundary within said mixture, heat from an external source being transferred to said fluid while said fluid flows through said drift tube means so as to increase the vapor pressure of said liquid portion thereof and thereby prevent condensation of said vaporized portion until a desired temperature is attained, said mixture flowing to said high pressure region experiencing a further increase in pressure in the absence of heat transfer thereto and therby experiencing a further increase in temperature as vapor therein condenses, said fluid flowing through said high pressure region and exiting in a liquid state at an elevated temperature.

2. A drift tube means as disclosed in claim 1 wherein said jet injector means comprises atomizing jet means, said atomizing jet means injecting said fluid into said low pressure region at high speed in the form of a mist of very fine fluid droplets to facilitate efficient coupling of momentum between said liquid and vapor phases of said mixture for compression of said vapor phase and to facilitate efficient heat transfer between said liquid and vapor phases of said mixture for maintaining said vapor phase in a saturated state.

3. A drift tube means as disclosed in claim 2 wherein said drift tube means includes a converging drift channel means, said fluid being injected into a region of large flow cross section of said drift channel means wherein said low pressure region is maintained for flash vaporizing a portion of said fluid, said momentum of said mixture carrying said mixture through said converging channel means to a region of small flow cross section, said vaporized portion of said mixture being compressed inside said converging channel means in flowing to said small flow cross section thereof and thereby producing said high pressure region therein.

4. A drift tube means as disclosed in claim 3 wherein said fluid source comprises a pressurized fluid source and said jet injector means includes a spray nozzle, pressurized fluid from said source being supplied to said spray nozzle for flow therethrough and thereby for transformation of the potential energy of the pressure of said fluid into kinetic energy.

5. A drift tube means as disclosed in claim 4 wherein said drift tube means includes a pump means, said pump means being coupled to said converging channel means, said pump means operating to remove fluid from said high pressure region and thereby operating in combination with the momentum of said fluid injected into said low pressure region at high speed from said atomizing jet means to maintain said low pressure region.

6. A drift tube means as disclosed in claim 5 wherein said drift tube means comprises a thermal energy accumulation means for effecting accumulation of thermal energy in a controlled volume coupled thereto, said thermal energy accumulation means operating in combination with said pressurized fluid source to supply fluid to said controlled volume for flow therethrough, said thermal energy accumulation means operating to transfer an amount of thermal energy from fluid flowing from said controlled volume to fluid flowing to said controlled volume sufficient to effect the accumulation of thermal energy inside said controlled volume and thereby cause said fluid to flow therethrough at an elevated temperature, said thermal energy accumulation means including a heat transfer duct means, said converging channel means and said heat transfer duct means being structurally coupled to each other in a counter flow heat-exchanger configuration, said liquid leaving said high pressure region at an elevated temperature, thereafter flowing through said controlled volume and inturn flowing through said heat transfer duct means, said fluid flowing through said heat transfer duct means supplying heat to said liquid-vapor mixture flowing through said converging channel means toward said controlled volume and thereby functioning as said external energy source, said counter flow configuration resulting in said fluid exiting said heat transfer duct means near the flash vaporization temperature of said fluid entering said first low pressure region from said jet injector means and thereby at a lower temperature and containing less thermal energy than when originally supplied from said source, said difference in thermal energy being accumulated inside said controlled volume.

7. A thermal energy accumulation means as disclosed in claim 6 wherein said pump means comprises a flow actuated pump means.

8. A thermal energy accumulation means as disclosed in claim 7 wherein said flow actuated pump means comprises a jet pump means, said jet pump means being coupled to said pressurized fluid source and being actuated by fluid flow therefrom, said jet pump means including a nozzle means, said pressurized fluid actuating said flow actuated pump means by flowing through said nozzle means and thereby experiencing an increase in velocity to produce a jet pump effect for removing fluid from said high pressure region.

9. A thermal energy accumulation means as disclosed in claim 8 wherein said jet pump means includes a feed water heating duct means, said feed water heater means being coupled between said pressurized fluid source and said nozzle means and coupling pressurized fluid flow from said source to said nozzle means, said feed water heating duct means having a portion thereof physically attached to said heat transfer duct means to facilitate transfer of heat from fluid flowing through said heat transfer duct means to fluid flowing through said feed water heating duct means, said fluid flowing through said feed water heating duct means being elevated to a temperature near that of fluid being pumped by said jet pump means from said high pressure region.

10. A thermal energy accumulation means as disclosed in claim 9 wherein said thermal energy accumulation means includes an exit duct means, a reservoir tank means and an over flow duct means, and said controlled volume means includes a collection tank means, said collection tank means and said reservoir tank means containing fluid and being physically positioned relative to each other so as to allow maintenance of equivalent fluid heights in each, said heat transfer duct means and said exit duct means being coupled to each other and comprising a siphon means coupled between said controlled volume means and said reservoir tank means, said heat transfer duct means including an inlet port means, said inlet port means extending into said collection tank means below the fluid level therein, said exit duct means including an outlet port means, said outlet port means extending into said reservoir tank means below the fluid level therein, fluid entering said controlled volume flowing to said collection tank means and thereby raising the fluid level therein, said siphon means being configured to transfer fluid from said controlled volume means to said reservoir means to maintain equivalent fluid heights in said collection tank means and said reservoir tank means, said reservoir tank means including an overflow drain means connected thereto for limiting the fluid level therein and thereby the fluid height within said collection tank means through to operation of said siphon means.

11. A thermal energy accumulation means as disclosed in claim 10 wherein said fluid flowing under pressure from a source comprises water flowing under pressure from a water main.

12. A thermal energy accumulation means as disclosed in claim 11 wherein said controlled volume comprises a bathroom shower.

13. A drift tube means as disclosed in claim 5 wherein said drift tube means comprises a thermal energy depletion means for effecting depletion of thermal energy from a controlled volume, said thermal energy depletion means operating in combination with a pressurized fluid source to supply fluid to said controlled volume for flow therethrough, said thermal energy depletion means operating to transfer an amount of thermal energy to fluid flowing from said controlled volume from fluid flowing to said controlled volume sufficient to effect a depletion of thermal energy inside said controlled volume and thereby cause said fluid to flow therethrough at a reduced temperature, said thermal energy depletion means including a heat transfer duct means, said converging channel means and said heat transfer duct means being structurally coupled to each other in a counter flow heat-exchanger configuration, said fluid flowing from said source through said heat transfer duct means supplying heat to said liquid-vapor mixture flowing through said converging channel means toward said high pressure region and thereby functioning as said external energy source, said fluid exiting said heat transfer duct means and flowing through said control volume at a reduced temperature, said fluid exiting said controlled volume and thereafter being injected into said low pressure region by said jet injector means, said counter flow configuration resulting in said fluid exiting said heat transfer duct means near the flash vaporization temperature of said fluid entering said low pressure region from said jet injector means and thereby at a lower temperature and containing less thermal energy than fluid leaving said controlled volume and flowing to said jet injector means, said mixture flowing through said converging channel means being increased in temperature to near that of fluid entering said heat transfer duct means from said source, said mixture flowing to said high pressure region experiencing a further increase in pressure in the absence of heat transfer thereto and therby experiencing a further increase in temperature as vapor therein condenses, said fluid flowing through said high pressure region and exiting in a liquid state at a temperature above that of fluid being supplied from said source, the difference in internal energy being the energy depleted from the controlled volume.

* * * * *